US005299883A

United States Patent [19]

Arth, Jr.

[11] Patent Number: 5,299,883

[45] Date of Patent: Apr. 5, 1994

[54] PROTECTIVE COVERING ASSEMBLAGE

[76] Inventor: Gerard J. Arth, Jr., 5750 Bradford Way, Hudson, Ohio 44236

[21] Appl. No.: 888,156

[22] Filed: May 26, 1992

[51] Int. Cl.[5] ..... E01F 15/00

[52] U.S. Cl. ..... 404/10; 52/301; 256/13.1

[58] Field of Search ..... 404/6, 10; 256/10, 11; 52/301, 515

[56] References Cited

U.S. PATENT DOCUMENTS

| | | | |
|---|---|---|---|
| 1,517,846 | 2/1924 | Lewis . | |
| 1,999,098 | 7/1935 | Hillyer et al. . | |
| 2,385,869 | 9/1945 | Lane . | |
| 2,450,345 | 4/1948 | Kervin . | |
| 3,104,875 | 2/1963 | Doyle . | |
| 3,448,585 | 3/1969 | Vogelsang . | |
| 4,183,505 | 1/1980 | Maestri | 404/10 X |
| 4,244,156 | 4/1981 | Watts, Jr. . | |
| 4,516,756 | 11/1985 | Beatty . | |
| 4,596,106 | 8/1986 | Kunczynski . | |
| 4,680,428 | 7/1987 | Wilson, Jr. | 52/301 X |
| 4,833,850 | 5/1989 | Lunn | 52/301 |
| 5,006,386 | 6/1991 | Menichini . | |

*Primary Examiner*—William P. Neuder

[57] ABSTRACT

A protective covering assemblage is releasable secured to a post extending from the ground. Protection means are mounted on and supported by a top portion of the post so as to cover at least a portion of the post which would be grazed by a passing vehicle. The protection means are rotatable mounted on the post and are made from a material which avoids damaging a vehicle when the vehicle comes into contact with the protection means.

8 Claims, 1 Drawing Sheet

PROTECTIVE COVERING ASSEMBLAGE

BACKGROUND OF THE INVENTION

The present invention relates generally to protective devices and, more particularly, it relates to protective covering assemblages for minimizing damage to vehicle bodies and the like.

It is commonplace in and around garages, bank and restaurant drive-thru's, and parking lots to utilize rigid vertical posts extending a few feet from the ground for purposes of controlling vehicular traffic. For instance, these posts allow for chains and the like to be connected thereto and extend therebetween so as to close-off such areas. Also, such posts delineate desired vehicle paths as well as serve to protect adjacent structures from being damaged by vehicles deviating from the desired path. The rigid posts are made from a variety of materials and typically are made of reinforced concrete or a concrete core surrounded by a metal casing. In normal usage, it is fairly common for vehicles to graze or impact these rigid posts. As a consequence thereof, the vehicle body is often damaged by ensuing scrapping, nicking, and/or denting. Today, of course, repairing vehicle body damage is a costly and time consuming experience.

Heretofore, the prior art has failed to disclose a protective covering assemblage which is easily attachable to a variety of posts or the like and which includes a protective member covering a portion of the post and which is rotatable if grazed by the moving vehicle so as to minimize and/or eliminate vehicle body damage that would otherwise be caused by the vehicle grazing an unprotected post.

SUMMARY OF THE INVENTION

It is an object of the present invention to overcome the disadvantages and shortcomings associated with the prior art by providing for a protective covering assemblage mountable on posts and the like which minimizes and/or eliminates damage to vehicular bodies which graze the protective assembly.

In accordance with the present invention, there is provided a protective covering assemblage which is releasably securable to a vertical post of the type used for vehicular traffic control. Included in the assemblage is protection means mountable on and supported by a top portion of the post so as to cover at least a portion of the post which would be grazed by a passing vehicle. The protection means is constructed so as to be rotatable about an axis of the post upon engagement of the protection means by a passing vehicle body. The protection means is made of material which when impacted by a passing vehicle body substantially avoids damage to the vehicle body.

In an illustrated embodiment, there is provided means attachable to the circumferential periphery of the vertical post, wherein this means is mountable adjacent a top portion thereof and which has retaining means formed on a portion thereof. The retention means is for retaining the protection means on the post.

In another illustrated embodiment, the attachable means is defined by strap means having end portions and which is wrappable around the periphery of the post. The strap means is provided with an adjustable connection means for joining the end portions of the strap means for allowing adjustability of the circumferential length of the strap means to a variety of posts having different peripheral circumferences.

In another illustrated embodiment, the strap means is provided with a tapered surface diverging from an exterior body surface and defining a retention shoulder of said retention means.

In another illustrated embodiment, the protection means is defined by a generally cylindrical-shaped hollow body, which has a body wall portion defining an open end to be fit over the post and a closed end portion adapted to mounted on the top of the post and which is rotatable about an axis of the post. The cylindrical-shaped body wall has side walls spaced from the post for facilitating rotatable displacement of the body. The wall portion is dimensioned to extend sufficiently along the length of the post, thereby protecting vehicle bodies from contacting the post.

In another illustrated embodiment, the protection means includes a radially extending lip extending inwardly from an internal surface of the cylindrical wall portion adjacent the open end. The lip is flexible so as to easily slide over the strap means when the protection means is being mounted on the post, and cooperates with the retention shoulder to prevent the protection means from being lifted off the post.

In another illustrated embodiment, the protection means is made from a resilient, deformable and cushionable material which avoids scratching or denting of vehicle bodies grazing them.

Among the objects of the invention are the provision of an improved protective covering assemblage adapted to be mounted on a vertical post so as to prevent vehicles from damaging the vehicle's body surface; the provision of an improved protective covering assemblage of the foregoing type which is rotatably mounted on the post so as to rotate when impacted by a passing vehicle body; the provisions of an improved protective covering assemblage of the foregoing type which is easily and economically manufactured; the provision of an improved assemblage of the foregoing type which is easily mountable on a post; the provision of an improved protective covering assemblage of the foregoing type which is adjustable to a variety of different dimensioned posts; the provision of an improved covering assemblage of the foregoing type which resists being removed from the post; and; the provision of the protective assemblage device of the foregoing type which cushions the vehicle body surface when striking the post.

Other objects and further scope of applicability of the present invention will become apparent from reading the detail description to follow when taken in conjunction with the accompanying drawings in which like parts are designated by like reference numerals throughout the several views.

DETAILED DESCRIPTION

Figure 1:
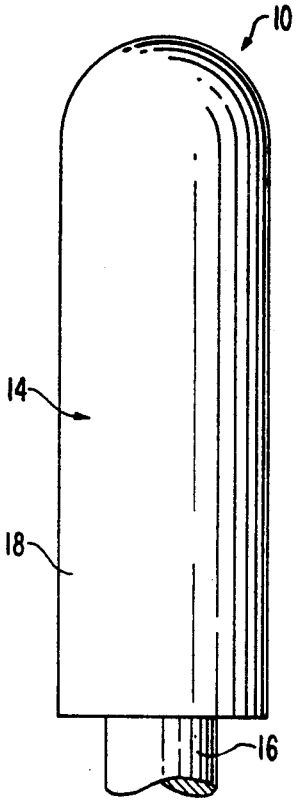
FIG. 1 is an elevational view of the improved cushioning protective assembly of the present invention which is shown mounted on a post.

Reference is made to FIGS. 1-4 for depicting one preferred embodiment of a protective covering assemblage 10 made according to the present invention. In this embodiment, the protective covering assemblage 10 includes a locking strap device 12 and a generally cylindrically-shaped protective covering member 14 which is removably mounted on a traffic post 16. Both the locking strap 12 and the protective covering member 14 are, as will be explained, constructed so as to facilitate easy and reliable installation thereof to the post 16.

The protective covering member 14 has a hollow cylindrical wall 18 with a generally bullet-shaped closed end 20 and an open flexibly resilient and durable polymeric material that attenuates the impact of forces thereon by automobiles grazing them without damage and destruction thereof as well as minimizes and/or eliminates vehicle body damage, such as scratching, nicking or denting. The polymeric materials should therefore, have sufficient impact strength characteristics, as well as other physical and chemical properties to allow them to be used repeatedly outdoors. Thus, besides strength considerations, environmental factors should be considered, such as thermal expansion, moisture absorption and resistance to chemical attack. Examples of the type of polymeric materials which can be used in this embodiment are polypropylene. Other types of materials, such as ABS, polyethylene, PVC and elastomeric materials having adequate mechanical, corrosion and wear properties can be utilized as well.

It is evident that the present invention contemplates a wide variety of materials which can resist the environmental abuse and, importantly, provide the desired strength and flexibly resilient characteristics desired to achieve the results of this invention. As noted, the protective covering member 14 is not fixed on the post, but is relatively rotatably displaceable with respect thereto so as to facilitate not only installation and removal, but importantly be capable of being rotated about a axis of the post 16 in response to being grazingly engaged by a passing automobile. In this regard, the internal surface 22 of the closed end 20 is constructed to support the protective member 14 for rotation relative to an axis of the post when seated thereon. Such relative rotation of the protective covering member 14 is advantageous as opposed to being fixed to the post. For instance, it allows the vehicle to move without abrading against a fixed covering. Moreover, since the covering is not being abraded, this tends to add to the durability of the protective covering member. The protective covering member 14, preferably, has a diameter such that it can be accommodated on a wide variety of existing different diametered posts. It is preferable, to have the inside surface 24 of the protective member 14 with sufficient clearance 25 relative to the post 16, so that it can rotate relatively easily with respect thereto when grazed by a moving vehicle. However, this invention envisions that the inside surface 24 of the wall 18 can engage the surface of the post 16 so long as it rotates relatively thereto. The exterior surface 26 of the protective covering member 14 is, preferably, smooth. Moreover, the surface 26 can have printing applied thereto.

Figure 2:
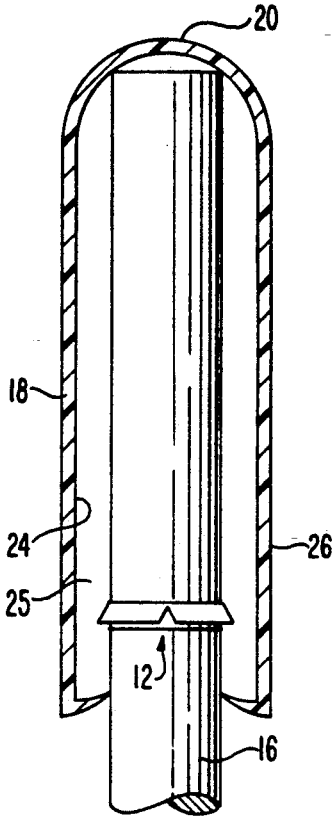
FIG. 2 is a partial cross-sectional view of the components forming the improved protective device of the present invention.
Figure 3:
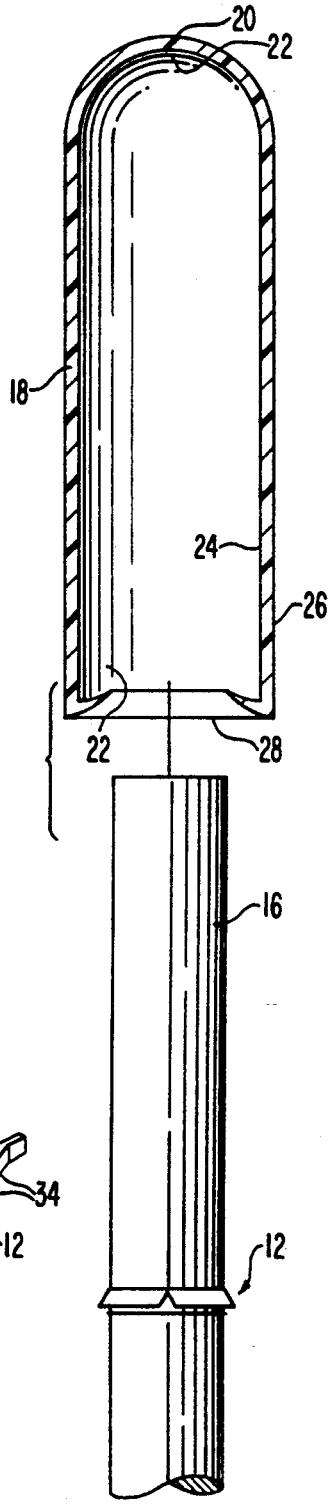
FIG. 3 is a partial cross-sectional view of the components being f,it on the post; and, FIG. 4 is a perspective view of one embodiment of a locking strap made according to the invention.
Figure 4:
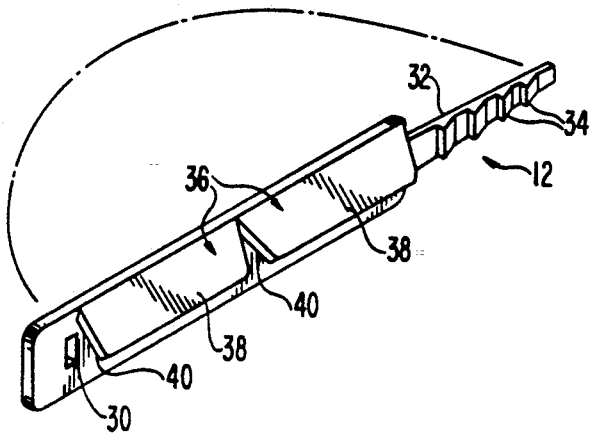

The open end portion 20 includes a resiliently flexible locking lip 28 which in the present embodiment is defined as a flexible thin-walled flange member. The locking lip 28 is normally curved upwardly, as shown in FIGS. 2&3, for reasons which will become apparent. The lip 28 is shown as a continuous member, but clearly that need not be so. The locking lip 28 is deflected upwardly upon downward sliding of the covering member 14 over the locking strap device 12. After such sliding, the lip 28 will resume its non-deflected position (FIG. 2) so that if someone attempts to pull-up on the protective covering member 14, such lifting will be resisted. This tends to thwart unwanted removal of the protective covering member. Reference is now made to FIG. 4 for better illustrating the adjustable locking strap 12, which is, in this embodiment, made of a single, flexibly resilient plastic material. In this embodiment, it is easily adaptable to a wide variety of posts having different circumference. The locking strap 12, as is best shown in FIG. 4 is, preferably, made of a single piece of flexibly resilient polyamide plastic such as nylon plastic. The strap 12 is adjustable and in this regard includes a slot 30 adjacent one end thereof, while at the other end thereof is provided with a flap 32 having a series of locking ridges 34 thereon which are intended to be inserted through the slot 30. Accordingly, the locking strap 12 can be secured to the post 16 so as to allow adjustability of its circumferential length to a variety of posts having different circumferences. The adjustable locking strap 12 can be made from a wide variety of material, such as polypropylene, ABS, polyethylene, PVC and, rubbers and diene rubbers.

Also, the locking strap 12 can have on its inner circumferential surface an adhesive layer (not shown). The adhesive layer tends to prevent the locking strap 12 from riding up or down after being applied to a post. It will further be appreciated that a variety of other techniques are contemplated by the present invention to achieve an affixing or removable attachment of the strap to the post 16. For example, it is contemplated that the strap can be an elastic band.

For retaining the covering member 14 on the post 16, the strap 12 is provided with a flared or diverging protrusion 36 that, when in the assembled position, provides a sloping outer surface 38. The protrusion 36 has a V-shaped notch thereon to facilitate bending thereof about a post. This surface 38 allows the flexible locking lip 28 to slide easily thereover when the protective covering member 14 is being installed. The protrusion 36 also provides a locking inner shoulder surface 40 on the underneath surface of the protrusion 36 which is to be interengaged by the locking lip 28 upon upward movement of the protective covering member 14.

After having given a detailed description of the construction of the protective covering assemblage of the present invention, its operation is self-evident.

Although the protective cover member 14 has a cap shaped closed end configuration which covers significant portions of the post surface area, other configurations of the cover member are contemplated. For instance, instead of a uniform cap configuration, the present envisions a cage-like construction which is, preferably, rotatably cooperable with the post, and which prevents an automobile body contacting the exterior surface I5 of the post. Such a cage-like construction would be made from materials which are similar to the covering member 14. Also, although the protective covering member 14 is.depicted as a single member, this invention contemplates that it can be made from an assembly of members as well.

I claim:

1. A protective covering assemblage releasably securable to a post of the type extending from the ground and used for vehicle traffic control, said assemblage comprising:

protection means mountable on and supported by a top portion of the post so as to cover a preselected portion of the top portion, said protection means constructed so as to be rotatable about an axis of the post upon grazing engagement of said protection means by a passing vehicle body said protection means being made of a material which when impacted by the passing vehicle body minimizes or avoids damage to the vehicle body.

2. The protective assemblage of claim 1 wherein said protection means has a generally cylindrical shaped hollow body which has a closed end portion which is adapted to be mounted on the top of the post and is spaced radially from longitudinal surfaces of the post so as to be rotatable thereabout, said cylindrical shaped portion having an open end for fitting over the top of the post and allowing said cylindrical body to extend a sufficient distance along the length of the post so as to protect vehicle bodies from contacting the post.

3. The protective covering assembly of claim 2 wherein said protectin means is made out of a flexibly resilient, deformable and cushionable maerial which avoids scratching or denting of vehicle bodies which grazingly engage therewith.

4. A protective covering assemblage releasably securable to a post of the type extending from the ground and used for vehicle traffic control, said assemblage comprising:

means attachable to a periphery of a vertical post, said means being mountable adjacent a top portion of the post and having retaining means connected thereto;

protection means mountable on and supported by a top portion of the post so as to cover a preselected portion of the top portion in spaced radial relationship thereto, said protection means constructed so as to be rotatable about an axis of the post upon grazing engagement of said protection means by a passing vehicle body, said protection means being made of a material which when impacted by the passing vehicle body minimizes or avoids damage to the vehicle body;

said protection means includes a radially inwardly extending locking member extending inwardly from an internal surface adjacent said open end, said locking member being flexible so as to easily slide over said attachable means when said protection means is being mounted on the post and which cooperates with said retention means to resist against said protection means being lifted off the post.

5. The protective assemblage of claim 4 wherein attachable means includes strap means which is wrappable about the post, and adjustable connection means for joining end portions of said strap means for allowing adjustability of the length of said strap means to a variety of posts having different circumference.

6. The protective assemblage of claim 5 wherein said retention means includes a tapered protruding surface diverging from a body portion of said strap and defining a retention surface which is engagable with said locking member.

7. The protection covering assemblage of claim 4 wherein said attachable means includes an adhesive material on an inner surface thereo so as to facilitate securing said attachable means in a fixed location on the post.

8. The protection covering assemblage of claim 3 wherein said cylindrical wall portion has a smooth exterior surface.

* * * * *